United States Patent [19]

Misöph

[11] Patent Number: 4,623,107

[45] Date of Patent: Nov. 18, 1986

[54] REGULATING SYSTEM FOR GUIDED MISSILES TRAVELING AT SUPERSONIC SPEED

[75] Inventor: Helmut Misöph, Lauf/Pegnitz, Fed. Rep. of Germany

[73] Assignee: Diehl GmbH & Co., Nuremberg, Fed. Rep. of Germany

[21] Appl. No.: 668,033

[22] Filed: Nov. 5, 1984

[30] Foreign Application Priority Data

Nov. 5, 1983 [DE] Fed. Rep. of Germany ..... 3340037

[51] Int. Cl.[4] ..... F42B 15/02; F42B 25/24

[52] U.S. Cl. ..... 244/3.22; 102/384

[58] Field of Search ..... 244/3.22, 3.24, 3.21; 102/384

[56] References Cited

U.S. PATENT DOCUMENTS

| | | | |
|---|---|---|---|
| 2,495,304 | 1/1950 | Wyckoff et al. | 102/384 |
| 2,584,826 | 2/1952 | Wyckoff | 102/384 |
| 3,096,739 | 7/1963 | Smith | 114/23 |
| 3,156,207 | 11/1964 | Giles | 244/3.22 |
| 3,724,782 | 4/1973 | Gauzza et al. | 102/384 |

FOREIGN PATENT DOCUMENTS

| | | | |
|---|---|---|---|
| 502517 | 5/1954 | Canada | 102/384 |
| 2856286 | 7/1980 | Fed. Rep. of Germany . | |

*Primary Examiner*—Charles T. Jordan

*Attorney, Agent, or Firm*—Scully, Scott, Murphy and Presser

[57] ABSTRACT

A regulating system for guided ammunition flying at supersonic speed, such as missiles, rockets, or projectiles which includes an arrangement for effecting the guidance through a partially changeable flow pressure. Provided on the ammunition are one or more steering systems in the form of ring-shaped or quasi-annular guidance mechanisms which are divided into sectors, and wherein the sectors cause a medium which become effective within the sectors to selectively and controllably block the airflow.

10 Claims, 6 Drawing Figures

REGULATING SYSTEM FOR GUIDED MISSILES TRAVELING AT SUPERSONIC SPEED

BACKGROUND OF THE INVENTION

1. Field of the Invention

The present invention relates to a regulating system for guided ammunition flying at supersonic speed, such as missiles, rockets, or projectiles which includes an arrangement for effecting the guidance through a partially changeable flow pressure.

2. Discussion of the Prior Art

From the disclosure of German Laid-open Patent Application No. 28 56 286 there has become known the stabilizing of missiles during flight while traveling at supersonic speed. Provided on the shell of the missile are radially directed nozzles. The medium streaming out of the nozzles produces a transverse force. This transverse force is adequate for the correction of the pitching or swinging movement of the missile. However, for the guidance of a missiles, the generatable transverse forces are inadequate.

SUMMARY OF THE INVENTION

It is an object of the present invention to propose a regulating system which is relatively simple in construction and which provides for a high degree of effectiveness.

The foregoing object is achieved through a regulating system as described hereinabove in which there is provided on the ammunition one or more steering systems in the form of annular or quasi-annular guidance mechanisms which are divided into sectors, and wherein the sectors cause a medium which become effective within the sectors to selectively and controllably block the airflow.

The inventive regulating system which, for instance, is controlled through the intermediary of sensors, utilizes aerodynamic effects which are generated in an annular surface which is streamed through, for example, an annular or ring-shaped guidance mechanism through a partial change in the surface which is streamed through by the flow.

For this purpose the cross-section which is streamed through by the flow in the region of a segment either aerodynamically by gas flows eminating from the nozzles or impulse charges from a gas quantity emitted within a short period, is intermittently closed either entirely or partly. Due to the changed resistance in the thus influenced flow, during the interval of this influence, there is exerted a steering or guiding moment on the missile. The regulating system is thus constructed extremely simple, in effect, without any movable components. This extremely simple construction possesses a high strength or resistance against extreme axial accelerations such as, for example, which are encountered by barreled weapons or tube-fired ammunition. Moreover, there are also obtained significantly reduced expenditures in comparison with other systems.

The present invention utilizes the choke effect which is encountered is barreled weapon-fired projectiles, in that there is blocked the entire region of its ring-shaped tail fin or a portion controlled thereby.

Hereby, in accordance with the invention it is important that through the proposed arrangement, a relatively small quantity of gas, or a mechanically-effective blocking surface for each sector, will be adequate for blocking the entire, or at least a portion essential for the guidance, of the cross sectional surface of the sector. This is predicated on the power amplification effect, in which the cross section of a sector surface which is optimized for the supersonic flow, need only be partially blocked in order to so adversely affect the conditions for the supersonic flow such that, as a consequence, there is blocked the largest or the entire portion of the cross sectional surface and, eventually, even adjoining regions of the ring-shaped tail fin sectors.

In accordance with a specific embodiment of the invention, the components which exert an effect on the target, such as the projectile-forming charge, are brought into a favorable starting position through a relatively large change in the direction of the ammunition, in a simple manner.

Pursuant to an other feature of the invention, for achieving the above-described effect, the gas quantity emitted by an impulse charge over a short period is adequate to achieve a steering or guidance effect on the ammunition.

Another feature and modification is obtained through the provision of gas generators, which afford the further advantage that by means of the lengthier outflow phase it is possible to produce a correspondingly enhanced guidance impulse. Pursuant to another feature of the invention, it is possible to attain an axially short construction which is protected from external influences, such as damaging of the regulating system.

In accordance with another feature of the invention, the pyrotechnic or mechanical means develop the greatest possible operative effects.

According to another aspect without necessitating extensive constructional measures it is possible to obtain a multiple function for each ring-shaped guidance mechanism sector. However, herein it is important that the subordinate located pyrotechnic means are oriented in a direction towards the incoming flow side of the ring-shaped guidance mechanism in order to achieve a maximum degree of effectiveness.

Through further features there is obtained a relatively favorable flow resistance. For the satisfactory guidability of the ammunition, a prerequisite is the relatively minor rotation of the ammunition. Hereby, a smaller angle of incidence for the sector segments is adequate. The sectors which are segmented in the direction of rotation are then respectively blocked in order to attain the desired guidance effect.

Pursuant to another aspect of the invention, the flow resistance is relatively favorable up to the phase of the target approach. The guidance mechanism is constructed simple, and is effective notwithstanding its subdivided construction.

In accordance with a further feature, the ammunition is guided during the phase of target approach through the individual effect of the forward guidance mechanism, or through the overall effect of the forward guidance mechanism and a rearward guidance mechanism, into a direction which is more favorable for a combat or warhead component.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
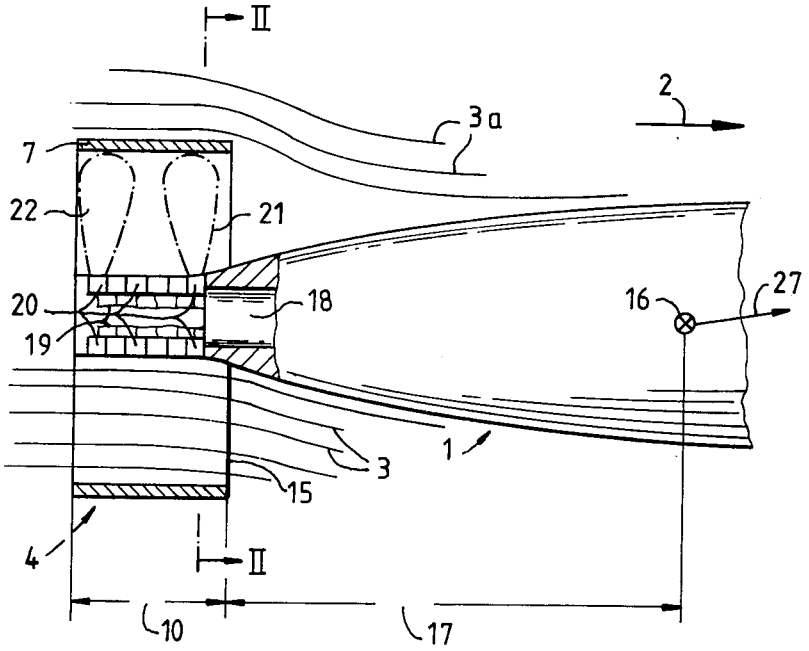
FIG. 1 illustrates a partially sectioned longitudinal view of a portion of a missile with a ring-shaped guidance mechanism.

A missile 1 travels at supersonic speed in the direction of arrow 2, wherein the flow lines are identified by reference numeral 3. On the missile 1, located on the housing 12 is an annular or ring-shaped guidance mechanism 4 with connectors 5, 90° flow sectors 6 with a ring-shaped tail fin 7, and a control device 18. The flow area within the ring-shaped guidance mechanism 4 is identified by reference numeral 10. The distance between the inflow opening 15 of the ring-shaped guidance mechanism 4 to the aerodynamic center of gravity 16 is identified by reference numeral 17.

Arranged behind each other in the flow area 10 within the missile 1 are electrically ignitable pyrotechnic cells 20 selectable through a control device 18, with electrical cables 19. These cells 20 can be constructed as impulse charges, or also as gas generators. In accordance with FIG. 1, the gas cloud which is ejected from the forwardmost cell 20 is illustrated in phantom lines and is identified by reference numeral 21. The gas cloud which is ejected from the rearmost cell is identified by reference numeral 22.

Figure 2:
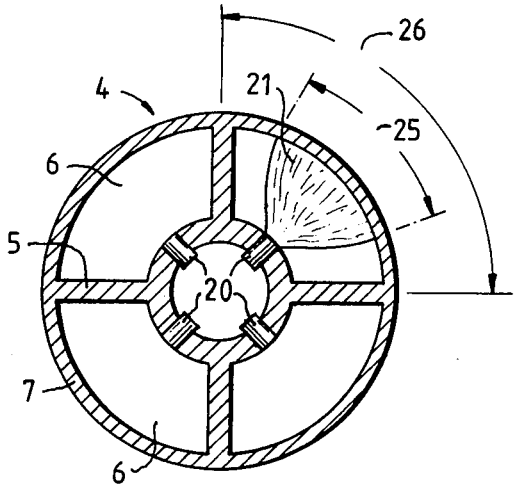
FIG. 2 is a sectional view through the ring-shaped guidance mechanism of FIG. 1 taken along line II—II.

The transverse expanse of the gas cloud 21 extends from FIG. 2, wherein the angle of the cloud 21 on the ring-shaped tail fin is designated by reference numeral 25. The corresponding angle of 90° of a blocked guidance mechanism sector is identified by reference numeral 26.

Pursuant to the cloud 21 which is illustrated in FIGS. 1 and 2, there is blocked the applicable guidance mechanism sector 6 with respect to the supersonic flow 3, as is indicated by the illustrated flowlines 3*a* in the upper portion of the drawing of FIG. 1. In accordance with the surface of the applicable guidance mechanism sector 1, there is generated a force which produces over the distance 17 a correction in the direction of the missile 1, somewhat in the direction of arrow 27.

Figure 2A:
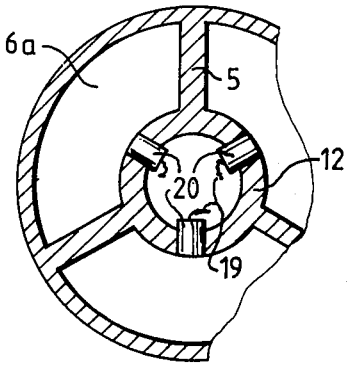
FIG. 2*a* is a ring-shaped guidance mechanism formed of 120° sectors.

In accordance with FIG. 2*a*, in a ring-shaped guidance mechanism there are provided sectors 6*a* each with a 120° span.

Figure 3:
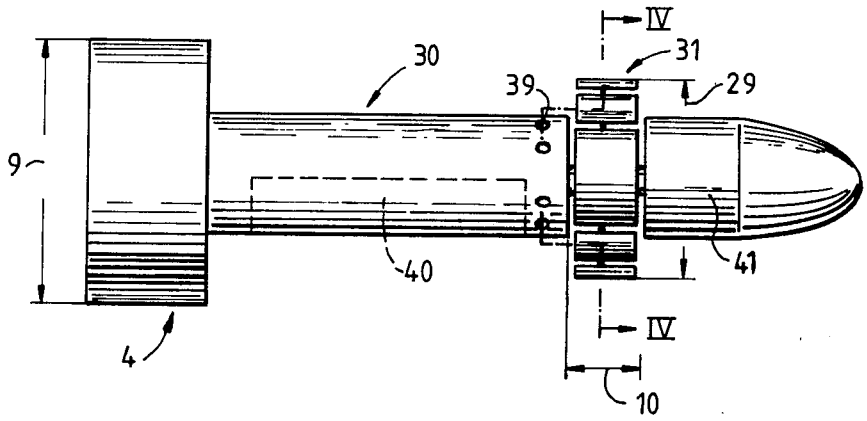
FIG. 3 illustrates another missile.

Pursuant to FIG. 3, a simplified illustrated missile 30 incorporates the stationery annular guidance mechanism 4, and a guidance mechanism 31 which acts as a ring-shaped guide mechanism. The diameter 29 of the latter is smaller than the diameter 9 of the annular guidance mechanism 4. The guidance mechanism 31 consists of radially displaceable guide support surfaces 32. In the starting condition according to FIG. 5, the support surfaces 32 cover each other. In the end condition according to FIG. 4, the support surfaces 32 are at the smallest possible sideways spacing 33, and at a flow effective radial spacing 34.

An extensively simplified shown regulating or setting device 35, in a known manner, consists of telescopable tubular components 36, 37, and of a gas generator 38.

Nozzles 39 for the generation of gas clouds 21 within the guidance mechanism 31 are arranged on the missile with regard to the individual flow sectors 11.

For the attacking of armored vehicles, the missile 30 is equipped with known per se projectile forming components 40.

The mode of operation of the guidance mechanisms 4 and 31 consist of in that the ring-shaped guidance mechanism 4, as is described with respect to FIGS. 1 and 2, effect the guidance of the missile 30 during cruise flight.

The guidance mechanism 31 is first extended during target approach in order to bring the projectile-forming components into a favorable angular position relative to the target. For this purpose, one or also a plurality of selected sectors 11 are blocked by means of a control device 41 through the nozzles 39 with respect to the airflow. The result is a correction in the direction of the missile 30 as is described with regard to FIG. 1.

However, during target approach there can be combined the effects of the partially blocked guidance mechanisms 4 and 31 through the concurrent or timewise offset activated flow sectors 6 and 11. Achieved hereby is an extensively more intense change in the direction of the missile.

In dependence upon the size of the missile and its areas of application, with respect to the rigid or radially movably constructed guidance mechanisms 4 and 31, there are also possible the following variants:

1.

Guidance mechanism 4 rigid
Guidance mechanism 31 rigid

2.

Guidance mechanism 4 movable
Guidance mechanism 31 movable.

For the radially movable support surfaces 32, in lieu of the telescopable components 36, 37, there can also be utilized gas-operated angle levers or other mechanical systems. Also suitable are the described pneumatic or pyrotechnic drive systems, as well as electrical or mechanical, or combined drive systems.

For effecting the blocking of the flow sectors 6 there can also be utilized mechanical devices, such as thin lamellar metallic plates which, through suitable regulating or setting systems, are introduced into the flow sectors 6 for a short-term or for constant blockage.

Figure 4:
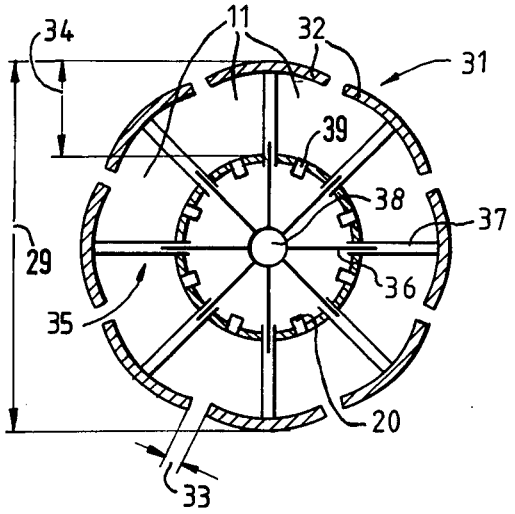
FIG. 4 is a sectional view taken along line IV—IV in FIG. 3.
Figure 5:
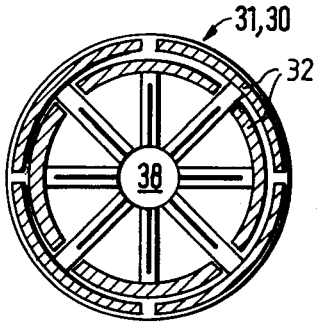
FIG. 5 illustrates the guidance mechanism of FIG. 4 in its starting condition.

In lieu of the four flow sectors 6 which are illustrated in FIG. 4, there can be provided as a minimum number only three sectors. Within the scope of the described embodiments it is also possible that, in lieu of the pyrotechnic cells 20, to provide a single nozzle for each guidance mechanism sector 6, which discharges a liquid or gaseous medium into the guidance mechanism sectors.

What is claimed is:

1. In a regulating system for guided ammunition flying at supersonic speed, such as missiles, rockets or projectiles, an arrangement for the guidance through a partially variable flow pressure; the improvement comprising: arranging at least one guidance systems on the ammunition in the form of annular or quasi-annular guidance mechanisms which are divided into sectors, and pyrotechnic gas-generating media becoming effective within the sectors to cause the sectors to selectively and controllably block the airflow therethrough.

2. System as claimed in claim 1, wherein at least two guidance systems are arranged in sequence in an axial direction on said ammunition, the forward located guidance system being smaller in diameter in conformance with the flow relationships for the rearward guidance system.

3. System as claimed in claim 1, wherein said pyrotechnic gas-generating media comprise impulse charges.

4. System as claimed in claim 1, wherein said pyrotechnic gas-generating media comprise gas generators.

5. System as claimed in claim 1, wherein said pyrotechnic gas-generating media and mechanical effective means are arranged on the ammunition in the areas bounded by the annular guidance mechanism.

6. System as claimed in claim 1, wherein the pyrotechnic gas-generating media are arranged on the ammunition symmetrically relative to connecting means for the annular guidance mechanism.

7. System as claimed in claim 1, wherein the pyrotechnic gas-generating media for each sector of the annular guidance mechanisms are arranged in multiples behind each other on the ammunition.

8. System as claimed in claim 1, wherein said guidance mechanism includes at least three equally-sized flow sectors, end means for blocking the airflow being associated with each said sector.

9. System as claimed in claim 2, wherein the forward guidance system comprises a telescopable guidance mechanism with radially displaceable support surfaces, the support surfaces in the retracted ineffective condition thereof being retracted within the contour of the ammunition.

10. System as claimed in claim 9, comprising control means for supplying support surfaces individually, in groups, or concurrently, radially extendably and selectively with a pyrotechnic medium.

* * * * *